US007896283B2

(12) United States Patent
Tauber et al.

(10) Patent No.: US 7,896,283 B2
(45) Date of Patent: Mar. 1, 2011

(54) APPARATUS FOR WINDING UP AT LEAST TWO MATERIAL WEBS

(75) Inventors: Adolf Tauber, Desselbrunn (AT); Robert Preuner, Weyregg (AT)

(73) Assignee: SML Maschinengesellschaft M.B.H., Lenzing (AT)

( * ) Notice: Subject to any disclaimer, the term of this patent is extended or adjusted under 35 U.S.C. 154(b) by 214 days.

(21) Appl. No.: 11/915,775

(22) PCT Filed: May 30, 2006

(86) PCT No.: PCT/AT2006/000221

§ 371 (c)(1),
(2), (4) Date: Nov. 28, 2007

(87) PCT Pub. No.: WO2006/128205

PCT Pub. Date: Dec. 7, 2006

(65) Prior Publication Data

US 2008/0191086 A1 Aug. 14, 2008

(30) Foreign Application Priority Data

May 30, 2005 (AT) ..... A 925/2005

(51) Int. Cl.
*B65H 18/08* (2006.01)

(52) U.S. Cl. ..... 242/530.1; 242/533.1; 242/533.4; 242/596.1

(58) Field of Classification Search ..... 242/530.1, 242/530.2, 533.1–533.5, 596.1–596.2, 596.4–596.5, 242/596.7

See application file for complete search history.

(56) References Cited

U.S. PATENT DOCUMENTS

| | | | | | |
|---|---|---|---|---|---|
| 3,381,911 | A | | 5/1968 | Thomas et al. | |
| 3,784,122 | A | * | 1/1974 | Kataoka | 242/525.7 |
| 3,848,824 | A | * | 11/1974 | Van Schijndel | 242/527.4 |
| 3,853,279 | A | * | 12/1974 | Gerstein | 242/521 |
| 4,438,888 | A | | 3/1984 | Seelinger | |
| 4,541,583 | A | * | 9/1985 | Forman et al. | 242/527.3 |
| 5,114,088 | A | * | 5/1992 | Cardano | 242/598.4 |
| 5,205,503 | A | | 4/1993 | Hutzenlaub | |
| 5,845,867 | A | * | 12/1998 | Hould et al. | 242/527 |

FOREIGN PATENT DOCUMENTS

| | | |
|---|---|---|
| JP | 2193851 | 7/1990 |
| JP | 6031683 | 2/1994 |
| JP | 2002020004 | 1/2002 |

* cited by examiner

*Primary Examiner* — Sang Kim
(74) *Attorney, Agent, or Firm* — Ladas & Parry LLP

(57) ABSTRACT

An arrangement for winding up at least two material webs, in particular film webs, having at least two receiving devices, for the rotatable mounting of at least one winding core each. The receiving devices are transferable between a winding position for winding up at least one material web on the winding core, and a removal or loading position, respectively, for removing at least one winding core which has finished being wound up, or for feeding at least one empty winding core. At least two winding cores are coaxially arranged in the receiving device for simultaneously winding up the material webs on separate winding cores, the winding cores each being rotatably mounted in two bearing sites adjacent to the respective winding core. The receiving device has at least three carrying arms, one winding core each being mounted between two carrying arms.

20 Claims, 7 Drawing Sheets

APPARATUS FOR WINDING UP AT LEAST TWO MATERIAL WEBS

BACKGROUND OF THE INVENTION

The invention relates to an arrangement for winding up at least two material webs, in particular film webs, comprising at least two receiving devices, for the rotatable mounting of at least one winding core each, wherein the receiving devices are transferable between a winding position for winding up at least one material web on the winding core, and a removal or loading position, respectively, for removing at least one winding core which has finished being wound up, or for feeding at least one empty winding core, respectively, and wherein at least two winding cores are coaxially arranged in the receiving device for simultaneously winding up the material webs on separate winding cores, the winding cores each being rotatably mounted in two bearing sites adjacent to the respective winding core. As the film webs, particularly stretch films, office films, décor films, aluminum foils, diaper films or the like can be provided. Yet, also webs of different materials, such as paper webs, composite laminates, textile webs and the like, may be wound up.

From the prior art, so-called turnover winders are already known which, for continuously winding up material webs, have at least one second position for removing a finished winder in addition to the winding position. Such winding-up devices may also work in-line with a production system in which an entire web of material is produced.

From JP 2002020004 A, a film winding device is known in which two laterally arranged drive shafts are provided for receiving one winding sleeve each for winding up two webs of film on two coaxially arranged winding sleeves. For centrally supporting the winding sleeves, a bearing element is provided on which non-driven bearings are provided on both sides for receiving the winding sleeves. The central bearing element is shiftably mounted so that the width of the winding sleeves can be adjusted variably. By the rotatable mounting of the two winding sleeves in laterally arranged drive shafts, the device according to the Japanese publication of the application is, however, limited to a maximum of two material webs to be wound up, which is a disadvantage. Moreover, the total width is unchangeably pre-determined by the laterally arranged drive shafts, and by adjusting the central bearing element, merely the width of one web of material can be reduced to the same extent as the width of the other web of material is enlarged.

In order to be able to subdivide an entire web of material which may have a width of up to 8 meters, e.g., into material webs of a few centimeters up to approximately 75 cm, it has been known to guide the entire material web over several deflection rolls to a longitudinal cutting station in which the entire material web is cut into several material webs. For winding up such an entire material web cut into several material webs, it has been known from IT MI98U000377 to set up in succession an appropriate number of winding-up devices for winding up one web of material each. Here, it is particularly disadvantageous that due to the number of winding-up devices that corresponds to the number of material webs, a large space is required, and such a total arrangement will be highly sensitive with regard to the straight guidance of the material webs on account of the required long guide of the material webs from the longitudinal film-cutting device to the respective winding device. With such a winding-up system, thus, the number of material webs to be wound up practically is restricted to a maximum of four material webs. Moreover, also changing the width of the material webs in such a device is only possible when the plant stands still.

JP 2193851 A describes yet another type of device for winding up an ink ribbon which is cut into a number of narrower ink ribbons by means of a cutting device. In that case, however, a continuous winding shaft is shown as is exactly to be avoided by the subject matter of the present invention.

It is an object of the present invention to provide an arrangement of the initially defined type, wherein several material webs, in particular also more than two material webs, can be wound up simultaneously with a single arrangement. A space-saving arrangement for winding up several material webs shall be created, in which in particular also running off of the material webs shall be avoided. Moreover, an adaptation to various widths of the material webs shall be possible with this arrangement.

This is achieved according to the invention in that the receiving device has at least three carrying arms, one winding core each being mounted between two carrying arms.

By the coaxial arrangement of a number of winding cores that corresponds to the number of material webs, and by mounting the winding cores between two carrying arms each in a single winding-up device, a space-saving arrangement for winding up a plurality of material webs, i.e. in particular also more than two material webs, can thus be provided. Due to the space-saving arrangement and the thus achieved shortening of the distances for the straight guiding of the material webs to the winding-up devices, winding on the winding cores with flush edges is, moreover, ensured. By providing two carrying arms each per winding core, the distance of these bearing sites, and the number of the carrying arms, respectively, can be adapted in a simple manner to the width of the material webs, or to the entire material web, respectively. Moreover, also here a simple and time-saving removal of the completed windings, or loading of the receiving device with the winding cores, respectively, is feasible. By providing two carrying arms each for mounting one winding core each, thus, any desired number of winding cores, in particular also 4, 5, 6, 7 etc. winding cores, can thus be wound simultaneously with one material web each of any desired width.

For moving the receiving devices to and fro in a simple manner between a winding position and the removing, or loading position, respectively, whereby continuous winding-up is enabled, it is suitable if the receiving devices are fastened to a common, rotatably mounted carrying device for a transfer between the winding position and the removing, or loading position, respectively.

For a simple construction of the mounting, adjacent winding cores can be rotatably mounted in one common carrying arm each.

In order to be able to adjust a any desired clear distance between two winding cores arranged in the receiving device, on the other hand it may, however, be suitable if each winding core is mounted in two carrying arms exclusively provided for the mounting of a single winding core, so that a total of four carrying arms is, e.g., provided for mounting two winding cores.

To wind up stretch films, it is particularly suitable if cylindrical sleeves are provided as the winding cores, wherein such cylindrical sleeves, or tubular winding cores, respectively, usually are made of paper or of a synthetic material.

To attain a so-called "shaftless" winding up of the material webs, wherein no continuous winding shaft is required for mounting the sleeves, it is suitable if the carrying arms have a center sleeve extending, or extendable, respectively, into the interior of the sleeve for clamping one sleeve each between two carrying arms.

If one center sleeve, in particular the center sleeve of an outwardly located carrying arm, has an associated torque drive, all winding cores which are coaxially arranged in the receiving device can be rotated by the driven center sleeve in that the remaining winding cores are hauled along by the winding core which is seated on the driven center sleeve.

In terms of a simple construction of the mounting of the winding cores it is suitable if at least two centrally arranged carrying arms each have a center sleeve cantilevering from the carrying arm on both sides thereof, or extendable therefrom, respectively.

If the center sleeve has a rotatably mounted centering pin which is shiftably mounted in the axial direction of the winding cores, the centering pin being transferable into its extended position via a pneumatic drive, the winding cores can be clamped between two center sleeves in a simple manner and, after one film has been completely wound up, removed again from the receiving device.

For a particularly space-saving design in which the centering pin can be extended without a piston rod, it is advantageous if the centering pin is fastened to the outer ring of a pivot bearing, wherein a central plate designed as a pneumatic piston is fastened to the non-rotationally arranged inner ring of the pivot bearing.

For transmitting the torque of a driven center sleeve to the remaining center sleeves in a simple manner, it is suitable if the center sleeves cantilevering from both sides of a carrying arm, or their extendable centering pins, respectively, are non-rotationally interconnected, in particular by positive fit.

In order to be able to realize high press-on forces and film tensions, particularly in case of sleeves with a comparatively narrow diameter of, e.g., 2 inches (=4.08 cm), it is advantageous if the sleeves are each mounted with a separate winding shaft between two carrying arms.

To achieve an adaptation of the bearing sites of the winding cores to different widths of the material webs in a simple manner, it is suitable if the carrying arms are mounted to be shiftable in axis direction of the winding cores.

For attaining a high press-on force of the film, it is suitable if each receiving device has an associated contact roll that is pivotably mounted on the carrying device. In this case, the contact roll suitably extends over the entire width of the receiving device, so that merely one common contact roll is associated with the winding cores that are coaxially arranged in the receiving device. If the contact roll mounted on the carrying device is driven, the winding cores can be driven via the contact roll, wherein, in particular, also a pre-acceleration of the winding cores is feasible by means of the contact roll in the removing, or loading position, respectively, before the winding cores are transferred into the winding position.

With a view to the pressing-on of the material webs to be wound up it is suitable if the receiving device provided in the winding position has an associated contact roll that is pivotable about a stationary axle. Also this contact roll which is mounted to be pivotable about a stationary axle suitably extends over the entire width of the receiving device so that merely one single common contact roll is associated to the winding cores. If this contact roll that is pivotable about a stationary axle is driven, driving of the winding cores for winding up the material webs can also be achieved via this contact roll, wherein in case of particularly wide designs, the contact roll may be supported by a middle arm.

For cutting the material webs transversely to their advancing direction after a winding has been completed, it is suitable if the receiving device provided in the winding position has an associated cutting device which separates the material webs transversely to the production direction.

For receiving or transporting away a finished coil, it is suitable if the receiving device provided in the removing, or loading position, respectively, has an associated height-adjustable table with a tiltable receiving plate. Of course, any other suitable automated device for removing the finished windings may, however, be provided.

In order to automatically feed a new, still empty winding core to the receiving device provided in the removal, or loading position, respectively, after removal of a finished winding, it is advantageous if the receiving device provided in the removing, or loading position, respectively, has an associated winding core depot.

If between two receiving devices, there is provided an intermediate receiving means with a winding shaft extending at least over the entire width of the material webs, or with a clamping device for clamping a single winding core extending over the entire width of the material webs, the width of the material webs can be changed by an intermediate step without being impeded by the carrying arms of the receiving device, and without having to reduce the winding speed for this. In normal operation, such an intermediate receiving means is, however, not provided with a winding shaft or sleeve, and is not transferred into the winding position, either, but is so only in case a change in the width of the material webs is to be carried out. Such an intermediate receiving means may also be used for the start-up of a film extrusion system, if the winding-up device is started up in-line with the extrusion system.

The invention will be explained in more detail by way of the exemplary embodiments illustrated in the drawings to which, however, it shall not be restricted.

BRIEF DESCRIPTION OF THE DRAWING FIGURES

In the drawings, in detail,

Figure 5:
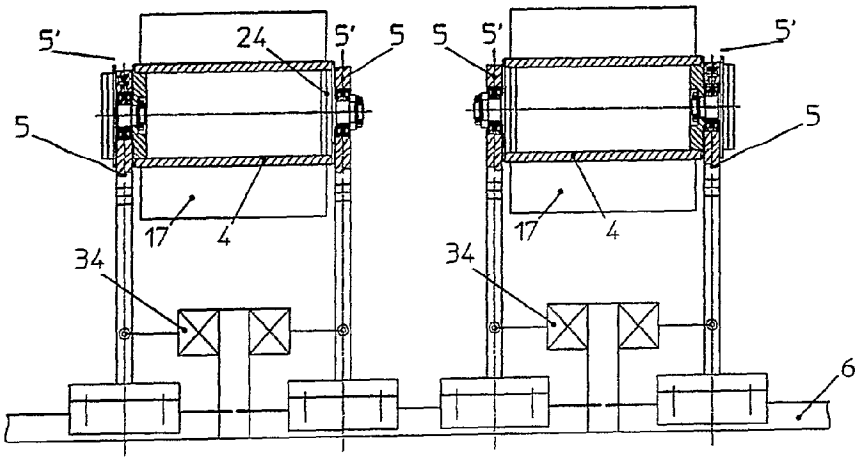
FIG. 5 shows a sectional view of the mounting of two winding sleeves.
Figure 5A:
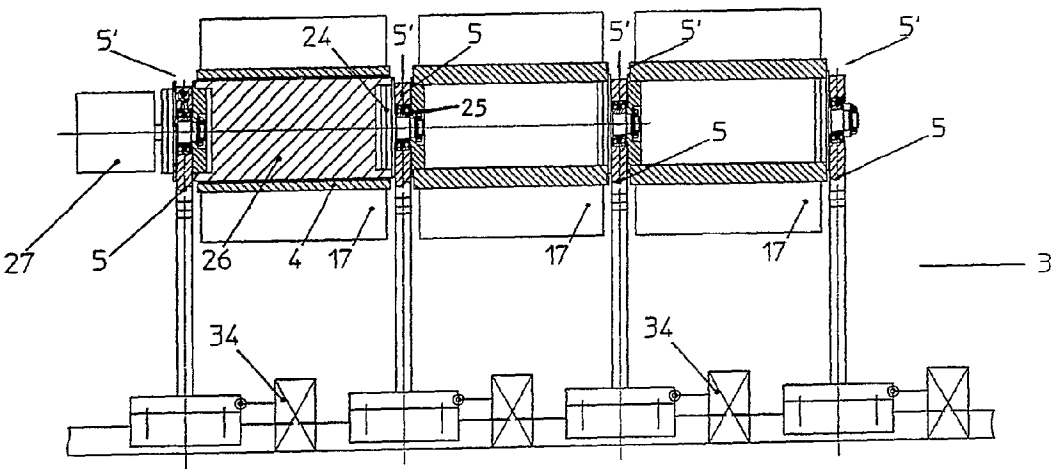
Figure 5C:
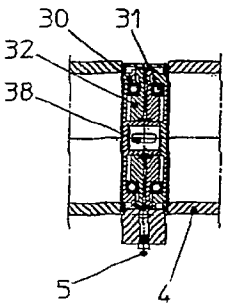
Figure 5B:
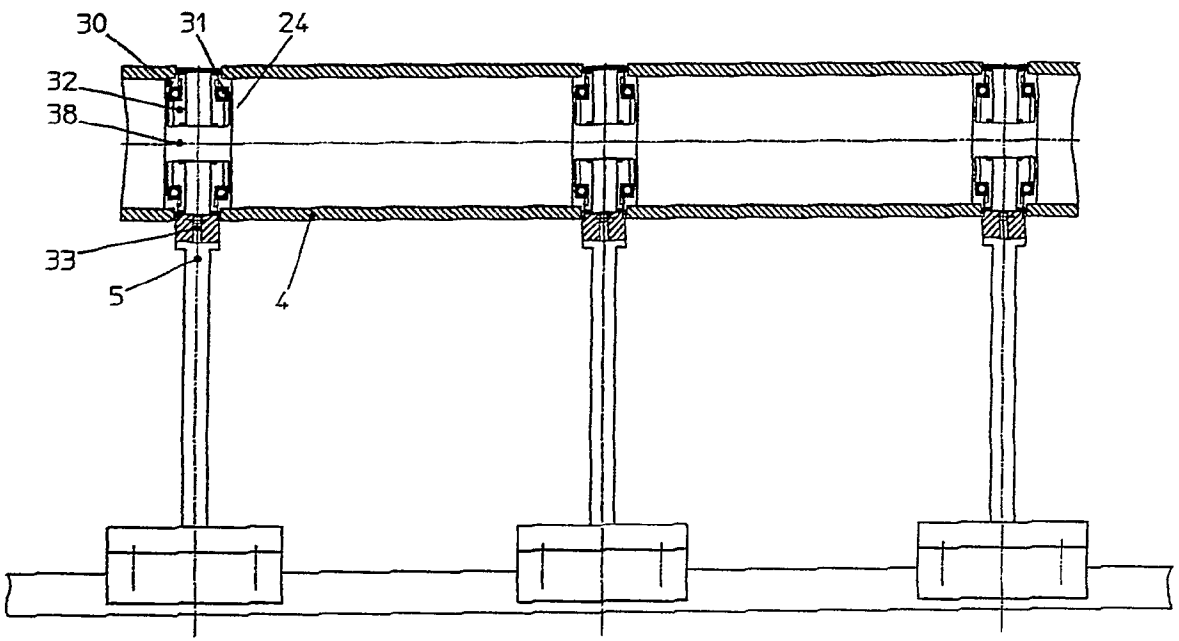
Figure 5D:
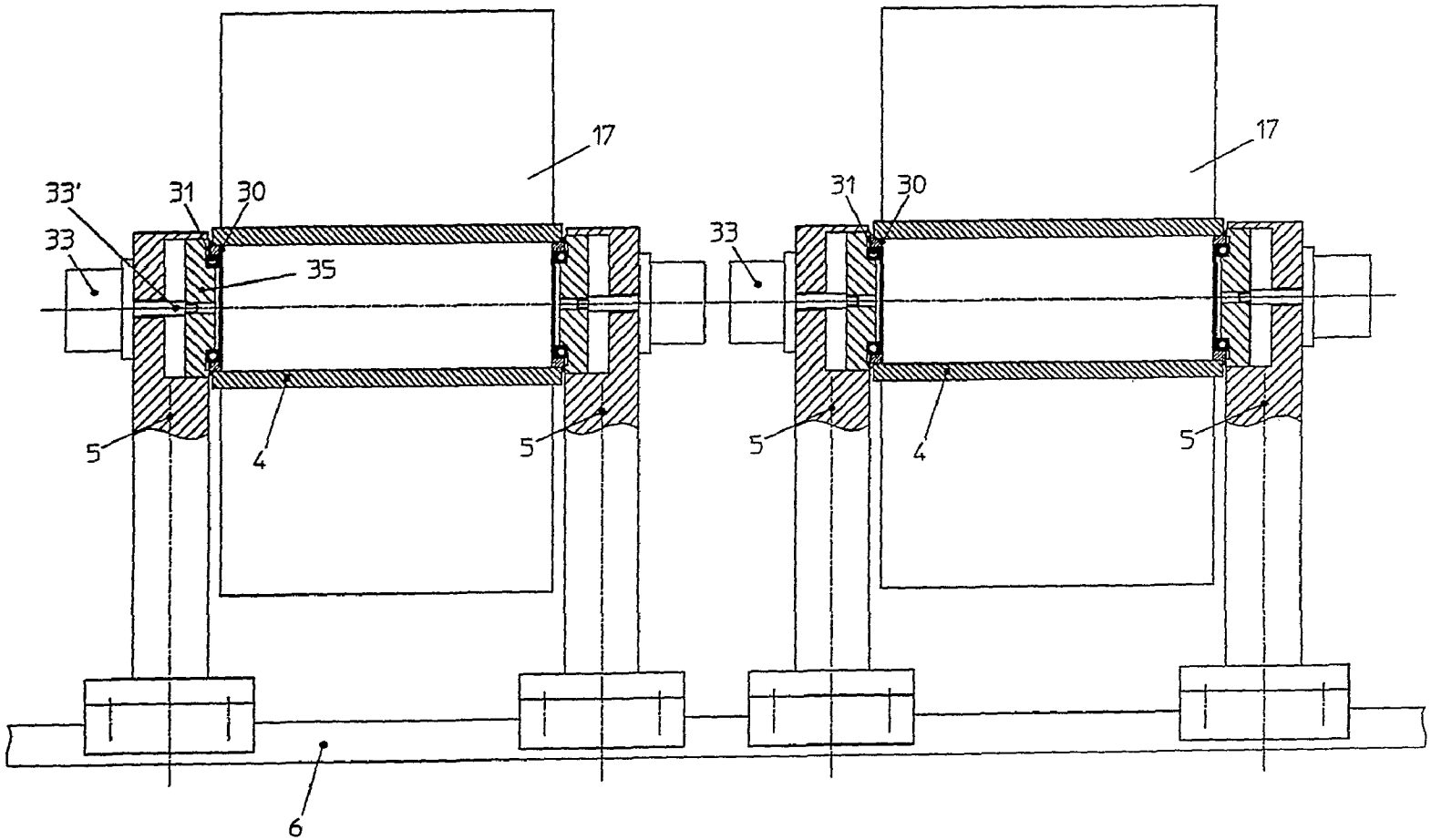
Figure 6:
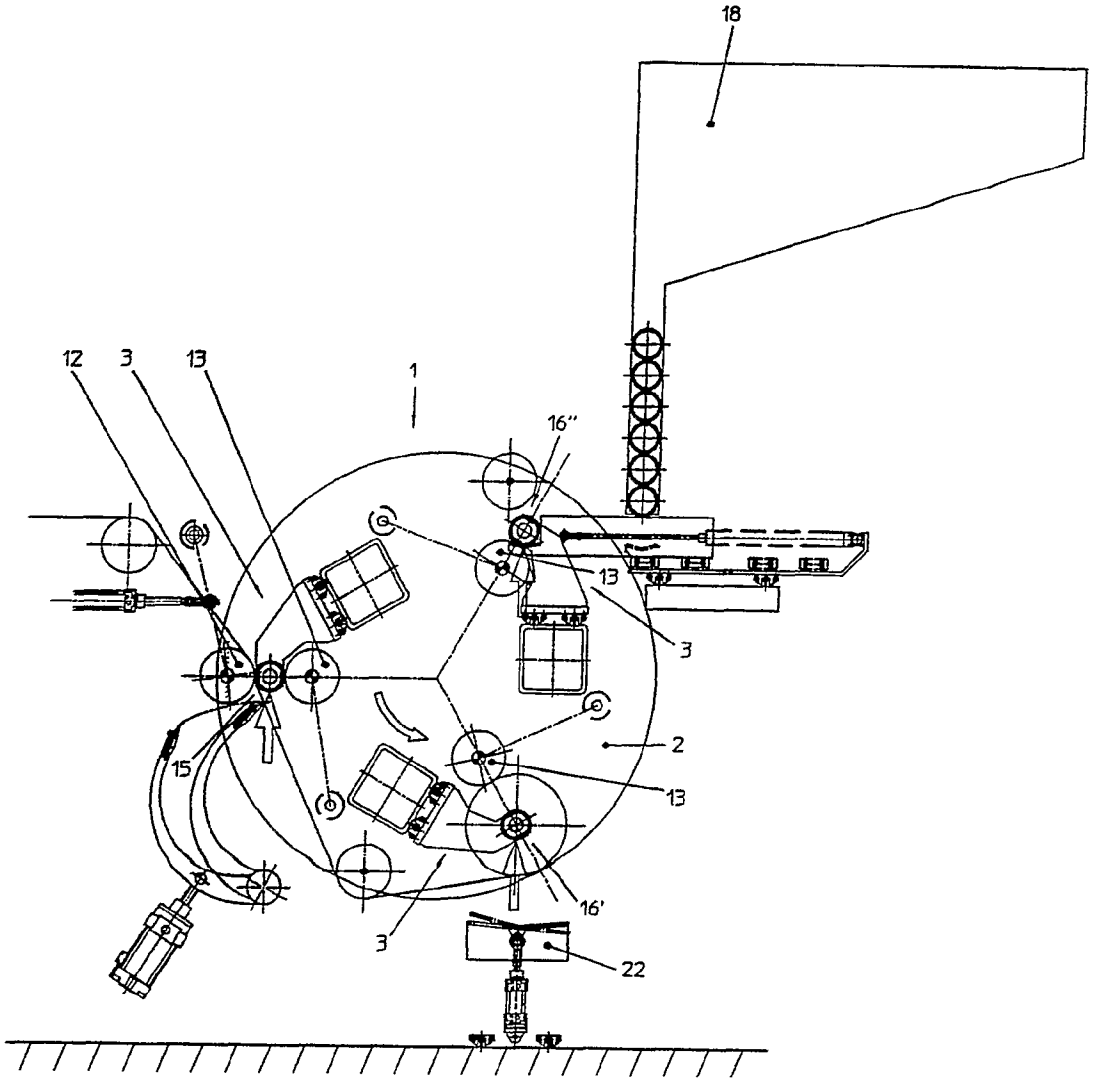
Figure 7:
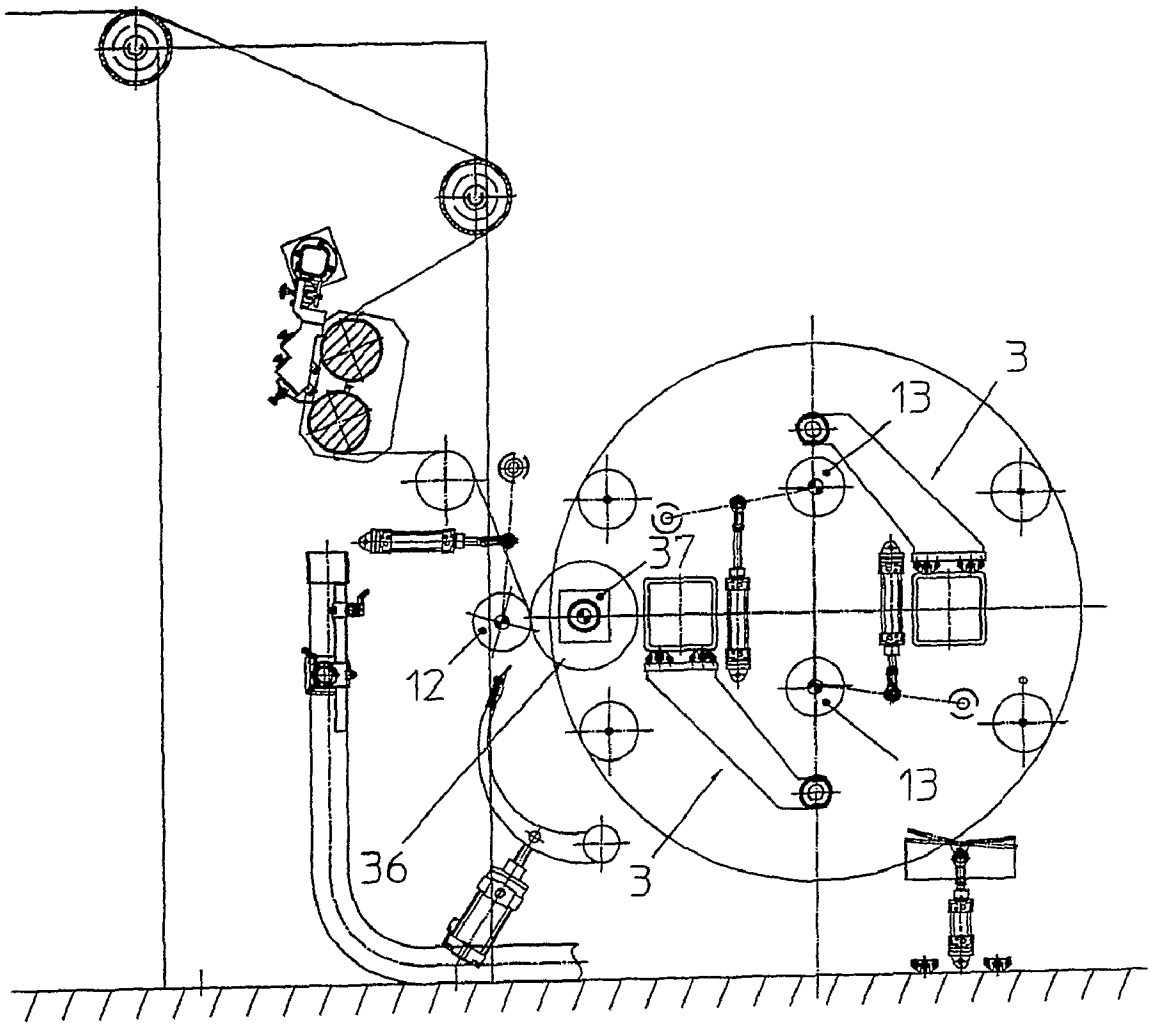

FIG. 5*a* shows a sectional view of the mounting of a winding sleeve with a winding shaft;

FIG. 5*b* shows a sectional view of a center sleeve which can be extended on either side;

FIG. 5*c* shows a sectional view of the center sleeve according to FIG. 5*b* in detail, yet in its retracted position;

FIG. 5*d* shows a view of the mounting of the winding sleeve in two separate carrying arms each;

FIG. 6 shows a view of a winding device 1 including three winding-up devices; and FIG. 7 shows a view with an intermediate receiving means for winding up the material webs on a common winding core.

DETAILED DESCRIPTION OF THE PREFERRED EMBODIMENTS

Figure 1:
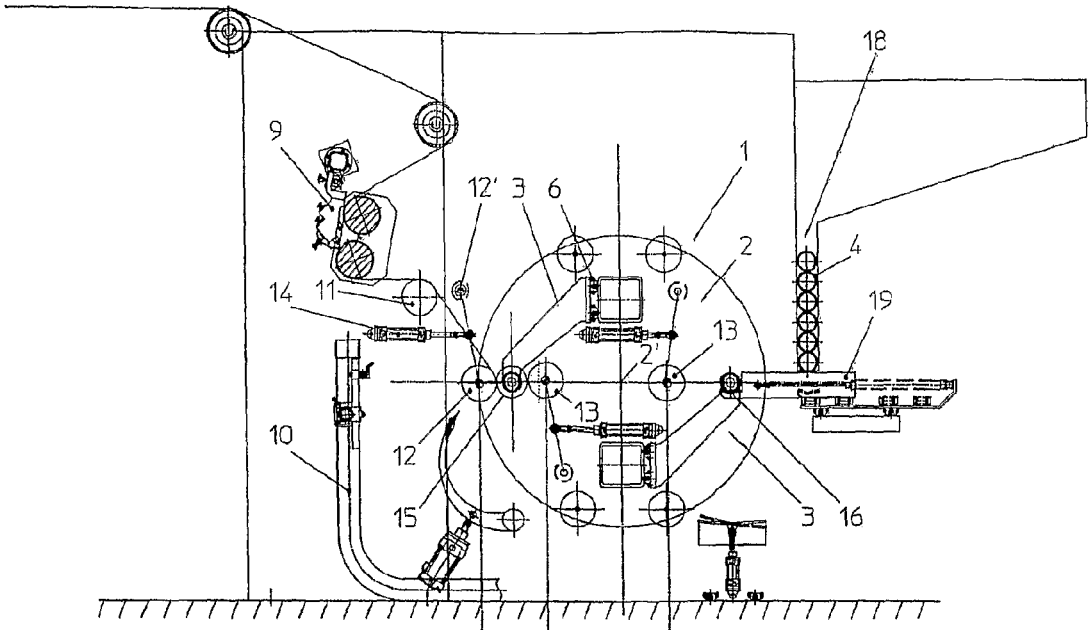
FIG. 1 shows a view of the winding-up device 1 having two receiving devices on which five winding cores each are coaxially mounted.
Figure 2:
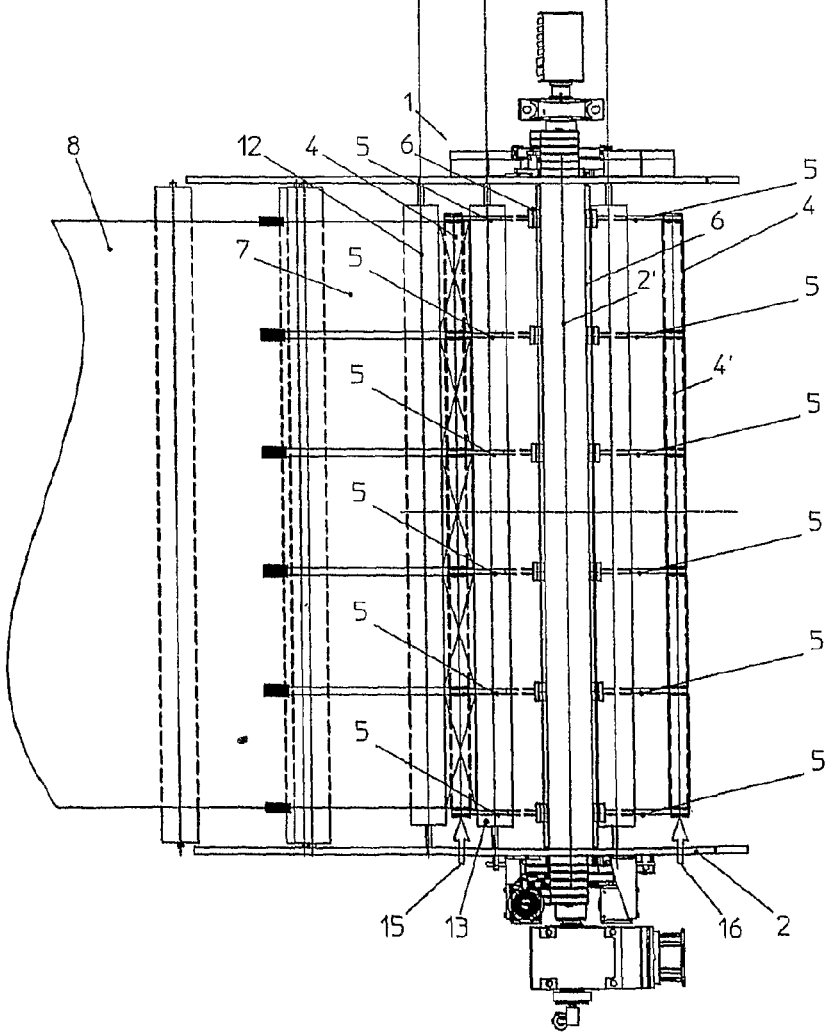
FIG. 2 shows a top view of the winding-up device according to FIG. 1.

In FIGS. 1 and 2, a winding-up device 1 is shown in which two receiving devices 3 are fastened on a carrying device 2, a so-called turn-over cross, for taking up several winding sleeves 4 arranged coaxially to each other.

Here, the take-up devices 3 each have six carrying arms 5 which are shiftably mounted in the direction of the common axis 4' of the winding cores 4 in a longitudinal guide 6. By providing the possibility of longitudinally shifting the carrying arms 5, the distance between two neighboring carrying arms 5, thus, can easily be changed and, thus, an adaptation to different widths of a web of material 7 can be achieved.

For receiving the material webs 7, in the exemplary embodiment illustrated, an entire material web 8 is cut into five material webs 7 by means of a longitudinal cutting device 9.

The webs 7 of material arriving from the cutting device 9 will then be guided over a deflection roll 11 to a contact roll 12 that is pivotably mounted in a stationary rotating axle 12', which contact roll 12 presses the material webs 7 against the winding cores 4 present in the receiving device 3. Here, the winding cores 4 usually will be paper or synthetic material sleeves having a diameter of approximately 2 or 3 inches (=4.08 or 7.62 cm) and a width of approximately from 250 to 750 mm.

Each receiving device 3, moreover, has an associated contact roll 13 pivotably mounted on the carrying device 2, the pressure, with which the film is pressed against the winding cores 4, being adjustable via said contact roll. Furthermore, the torque can be transmitted to the winding cores 4 via the contact rolls 12, 13. As an alternative, this is also possible via one or more bearing sites of the winding cores 4. For pivoting the contact rolls 13, or the contact roll 12, respectively, one lifting arm 14 each is provided. As is particularly visible in FIG. 2, the width of the contact rolls 12, 13 each extends over the entire width of the five coaxially arranged winding cores 4.

At the same time at which the material webs 7 are wound around the winding cores 4 present in a winding position 15, the finished film windings 17 arranged on the receiving device 3 present in a removing or loading position 16, respectively, (cf. FIG. 3) can be unloaded, and the receiving device 3 can be loaded with empty winding cores 4. For this purpose, a winding core depot 18 is associated to the removing or loading position 16, respectively, in which depot a plurality of winding cores 4 is kept on stock, the winding cores 4 being fed to the receiving device 3 present in the loading or unloading position 16, respectively, by means of a slide 19.

Figure 3:
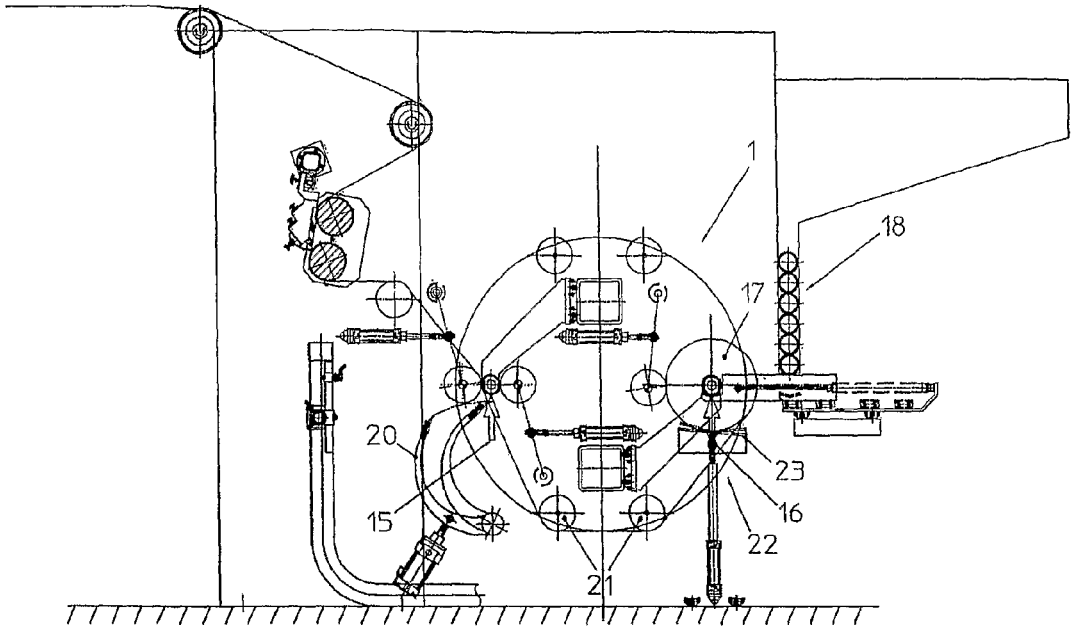
FIG. 3 shows the winding-up device 1 according to FIG. 1, yet with a finished film winding in the unloading or loading position, respectively.
Figure 4:
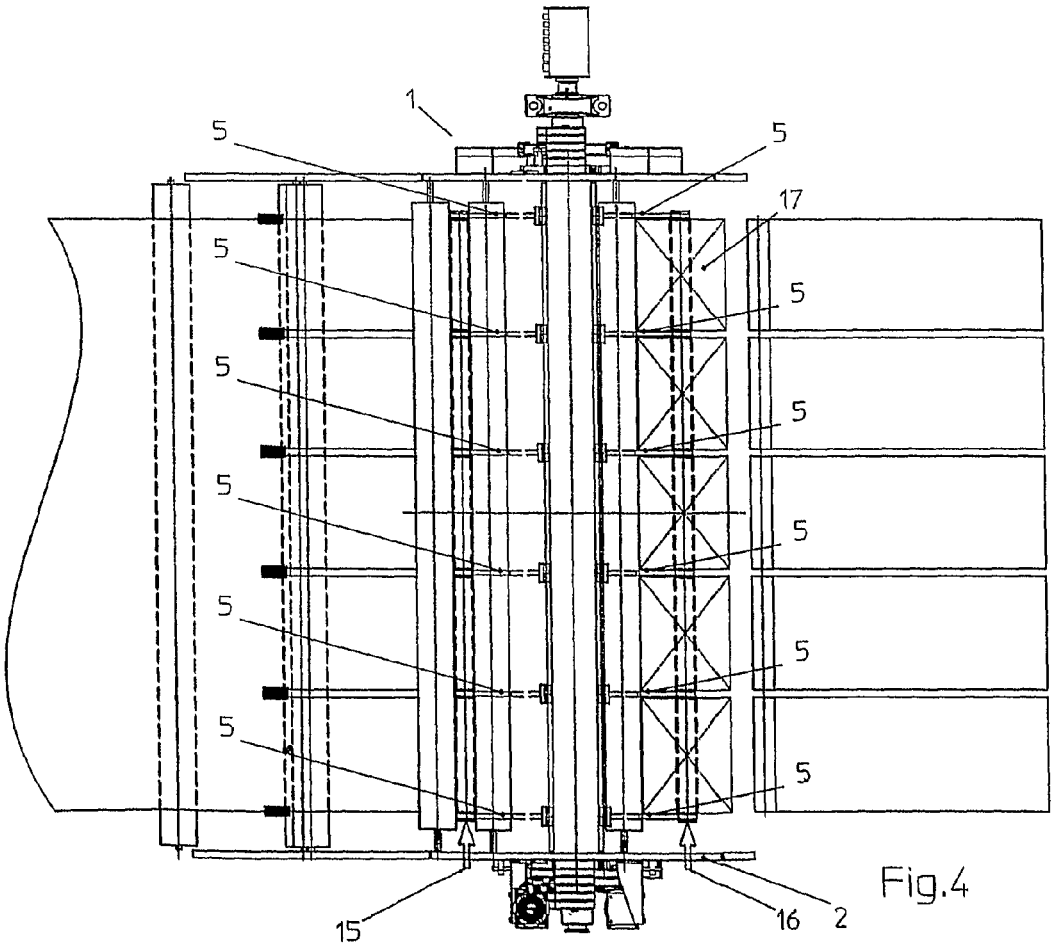
FIG. 4 shows a top view on the winding-up device according to FIG. 3.

As is particularly visible in FIG. 3, a completed film winding 17 is rotated by 180° around the axis 2' from the winding position 15 into the removing or loading position 16, respectively, by means of the carrying device 2. Subsequently, the material webs 7 which are guided over deflection rolls 21 will be cut transversely to the direction of their longitudinal extension by means of a pivotably mounted cutting knife 20 so that winding will start anew on the winding cores 4 newly introduced into the winding position 15, while in the loading or removing position 16, respectively, the rest of the material webs 7 at first will be wound up, before a height-adjustable table 22 is moved towards the finished film windings 17 for receiving the latter. The height-adjustable table 22 has a tiltable tabletop 23, whereby the film windings 17 received on the tabletop 23 can be moved onwards by a tilting movement, once the table 22 has been lowered.

In FIG. 5, the shaftless mounting of the sleeves provided as winding cores 4 can be seen, by clamping them between two bearing sites 51 each provided on the bearing arms 5, wherein in the exemplary embodiment illustrated one winding core 4 each is shown as clamped between two separate carrying arms 5. To this end, one center sleeve 24 each directed towards the winding core 4 cantilevers from the carrying arms 5. Introduction of a centering pin 30 into the winding core 4 is effected by shifting the carrying arms 5 in axial direction 4' of the winding core 4. For this purpose, a respective drive is provided in the region of the longitudinal guide 6 as a clamping device 34 via which the centering pins 30, which are non-displaceably mounted in axial direction on the carrying arms 5, are pressed into the winding core 4. By doing without a winding shaft extending over the entire width of the material webs 7, the sleeves 4 can be manipulated extremely quickly and, thus, the cycle time for finishing a film winding can be minimized.

In FIG. 5*a*, in the winding cores 4 which are the central and right ones in this illustration, also a shaftless mounting of the sleeves provided as the winding cores 4, by clamping them between two bearing sites 5' each provided on the bearing arms 5 can be seen. In the exemplary embodiment illustrated, one center sleeve 24 each is provided in the carrying arms 5, cantilevering from the carrying arms 5 on both sides thereof—except for the outwardly contacting carrying arms 5—the sleeves 4 being clamped between these center sleeves. The center sleeves 24 which cantilever on both sides share a bearing 25 in one carrying arm 5 each. Merely the outwardly arranged carrying arms 5 have only a one-sided, inwardly oriented center sleeve 24.

Moreover, the—in the illustration left—winding core 4 in FIG. 5*a* shows an alternative mounting of the winding cores 4 with a winding shaft 26. Here, the winding shafts 26 are together inserted into and removed from the sleeves 4 and are each mounted at two bearing sites 5' in the carrying arms 5. Here, the winding shafts 26 are supported on center shafts 24 just as in the shaftless exemplary embodiment according to FIG. 5, and here, too, insertion of the centering pins 30 into the winding cores 4 is achieved by shifting the carrying arms 5 in axis direction 41 of the winding cores 4 by means of the clamping device 34.

For rotationally driving the winding cores 4, a torque motor 27 is provided, via which the center sleeve 24 located on the left outer side in FIG. 5*a* is driven. The drive moment is transmitted by the frictional connection between the center sleeves 24 and the front faces of the winding core 4 seated on the driven center sleeve 24 and it propagates from one winding core 4 to the next one. If winding shafts 26 are used, this connection may also be by positive fit. Using winding shafts 26 is particularly suitable with small winding core diameters of 1.5 inches (=3.81 cm), e.g., and larger clamped widths so as to increase the bending stiffness of the winding sleeves 4.

In FIG. 5*b*, a space-saving embodiment of center sleeves 24 effective on either side is shown. In FIG. 5*b*, the center sleeves 24 are shown in their extended state, in which one winding core 4 each is clamped between two carrying arms 5. The center sleeves 24 each embrace one bearing 31 which carries a centering pin 30 rotationally movably on the outer ring for receiving the winding cores 4. The central part 32 connected to the inner ring of the bearing 30 is designed as a pneumatic piston so that the centering pins 30 move outwards when compressed air is introduced via an air supply channel 33; a piston rod, thus, is not required. Of course, the center sleeves 24 may also be only one-sided.

In FIG. 5*c*, the center sleeve 24 designed as a pneumatic cylinder without piston rod is shown in detail in the retracted position. In this retracted position, the winding cores 4 thus can be inserted, and the completed film coils 17 with their winding cores 4 can be removed. Furthermore, in FIG. 5*c* a positive fit connection 38 by means of a groove/tongue connection between the two centering pins 30 is visible. By means of the positive fit connection 38, the two centering pins 30 are non-rotationally interconnected so that the torque introduced via a torque motor 37 can be transmitted in a simple way and, thus, the remaining winding cores 4 can be hauled along.

In FIG. 5*d*, once more an exemplary embodiment is shown in which each winding sleeve 4 is mounted in a separate left and right carrying arm 5. Here, extendable center sleeves 24 effective in one direction are provided, which can be moved out in the mode of operation described in the context of FIGS. 5*b* and 5*c*.

This exemplary embodiment also particularly allows for the use of a structurally simple center sleeve clamping device with a conventional short stroke pneumatic cylinder 33 having a piston rod 331. In this case, the piston rod 33' is centered in the carrying arm 5. The piston rod 33' is connected to the centering member 35 which does not co-rotate and which receives the inner ring of the bearing 31.

In FIG. 6, an alternative exemplary embodiment of the winding-up device 1 is shown in which three receiving devices 3 each having at least three carrying arms 5 are provided, the receiving devices 3 here being arranged offset relative to each other on the carrying device 2 by 120° each.

In comparison with the exemplary embodiment shown in FIGS. 1 to 4, here the loading and removing station 16, respectively, is divided into a removing station 16' and a loading station 16" offset to the former by 120°. Here, too, the receiving devices 3 each have a contacting roll 13 via which, in the removing position 16, in particular driving of the winding cores 4 for completing the winding of the final portions of the material webs 7, and in the loading position, in particular pre-accelerating of the winding cores 4 to the winding speed in the winding position 15 can be effected.

In FIG. 7, a winding device 1 is shown in which an intermediate receiving means 36 is provided between the receiving devices 3, in which intermediate receiving means—in an intermediate step—winding up of the entire material web 8 on a winding shaft 37 or on a sleeve 4 that extends over the entire width of the material webs 7 can be effected. With the help of this intermediate receiving means 36, the spacing of the carrying arms 5 relative to each other can be changed without reducing the speed of the winding up device 1, and, thus, the width of the material webs 7 can be changed, or adapted, respectively. Differently from the exemplary embodiment illustrated, the material webs 7 may, of course, also have different widths, as can be adjusted easily by the shiftability of the carrying arms 5 in the linear guide 6. Such an intermediate receiving means 36 may also be used for the start-up of a film extrusion system, when the winding-up device 1 starts up in-line with the extrusion system.

The number of winding cores 4 may, of course, vary as desired. For an easy manipulation of the individual winding cores 4 that is as rapid as possible, it is merely essential for the winding cores 4 each to be rotatably mounted in two bearing sites 5' located adjacent the winding cores 4.

The invention claimed is:

1. An arrangement for winding up at least two material webs, in particular film webs, comprising at least two receiving devices, for the rotatable mounting of at least one winding core each, wherein the receiving devices are transferable between a winding position for winding up at least one material web on the winding core, and a removal or loading position, respectively, for removing at least one winding core which has finished being wound up, or for feeding at least one empty winding core, and wherein at least two winding cores are coaxially arranged in the receiving device for simultaneously winding up the material webs on separate winding cores, the winding cores each being rotatably mounted in two bearing sites adjacent to the respective winding core, wherein the receiving device has at least three carrying arms, one winding core each being mounted between two carrying arms, wherein the receiving device provided in the winding position has an associated driven contact roll for driving the respective winding cores.

2. The arrangement according to claim 1, wherein the receiving devices are fastened to a common rotatably mounted carrying device for a transfer between the winding position and the removing or loading position, respectively.

3. The arrangement according to claim 1, wherein each winding core is mounted in two carrying arms exclusively provided for the mounting of a single winding core.

4. The arrangement according to claim 1, wherein cylindrical sleeves are provided as the winding cores.

5. The arrangement according to claim 4, wherein the carrying arms have a center sleeve extending, or extendable, respectively, into the interior of the sleeve for clamping one sleeve each between two carrying arms.

6. The arrangement according to claim 5, wherein said center sleeve, in particular the center sleeve of an outwardly located carrying arm, has an associated torque drive.

7. The arrangement according to claim 5, wherein at least two centrally arranged carrying arms each have a center sleeve cantilevering from the carrying arm on both sides thereof or extendable therefrom, respectively.

8. The arrangement according to claim 7, wherein the center sleeves cantilevering from both sides of a carrying arm, or their extendable centering pins, respectively, are non-rotationally interconnected, in particular by positive fit.

9. The arrangement according to claim 5, wherein the center sleeve has a rotatably mounted centering pin which is shiftably mounted in the axial direction of the winding cores, the centering pin being transferable into its extended position via a pneumatic drive.

10. The arrangement according to claim 9, wherein the centering pin is fastened to an outer ring of a pivot bearing, wherein a central plate designed as a pneumatic piston is fastened to a non-rotationally arranged inner ring of the pivot bearing.

11. The arrangement according to claim 1, wherein the sleeves are each mounted with a separate winding shaft between two carrying arms.

12. The arrangement according to claim 1, wherein the carrying arms are mounted to be shiftable in axis direction of the winding cores.

13. The arrangement according to claim 12, wherein one shifting, or clamping device, respectively, each is associated to the carrying arms for shifting and fixing the carrying arms in a longitudinal guide.

14. The arrangement according to claim 1, wherein each receiving device has an associated said contact roll that is pivotably mounted on the carrying device.

15. The arrangement according to claim 1, wherein the receiving device provided in the winding position has an associated said contact roll that is mounted to be pivotable about a stationary axle.

16. The arrangement according to claim 1, wherein the receiving device provided in the winding position has an associated cutting device for cutting the material webs transversely to the advancing direction.

17. The arrangement according to claim 1, wherein the receiving device provided in the removing, or loading position, respectively, has an associated height-adjustable table with a tiltable receiving plate.

18. The arrangement according to claim 1, wherein the receiving device provided in the removing, or loading position, respectively, has an associated winding core depot.

19. The arrangement according to claim 1, wherein between two receiving devices, an intermediate receiving means with a winding shaft extending at least over the entire width of the material webs, or with a clamping device for clamping a single winding core extending over the entire width of the material webs is provided.

20. An arrangement for winding up at least two material webs, in particular film webs, comprising at least two receiving devices, for the rotatable mounting of at least one winding core each, wherein the receiving devices are transferable between a winding position for winding up at least one material web on the winding core, and a removal or loading position, respectively, for removing at least one winding core which has finished being wound up, or for feeding at least one empty winding core, and wherein at least two winding cores are coaxially arranged in the receiving device for simultaneously winding up the material webs on separate winding cores, the winding cores each being rotatably mounted in two bearing sites adjacent to the respective winding core, wherein the receiving device has at least three carrying arms, one winding core each being mounted between two carrying arms, wherein the receiving device provided in the winding position has an associated driven contact roll for driving the respective winding cores without laterally arranged drive shafts for driving each winding core.

* * * * *